US007520549B2

(12) United States Patent
Leighton

(10) Patent No.: US 7,520,549 B2
(45) Date of Patent: Apr. 21, 2009

(54) ERGONOMIC PROPANE TANK CARRIER AND STABILIZER

(75) Inventor: Lisa Leighton, Corona, CA (US)

(73) Assignee: Canterbury Enterprises, Inc., Corona, CA (US)

( * ) Notice: Subject to any disclaimer, the term of this patent is extended or adjusted under 35 U.S.C. 154(b) by 0 days.

(21) Appl. No.: 12/006,657

(22) Filed: Feb. 25, 2008

(65) Prior Publication Data

US 2008/0296921 A1 Dec. 4, 2008

Related U.S. Application Data

(60) Division of application No. 11/729,160, filed on Mar. 28, 2007, now Pat. No. 7,316,435, which is a continuation of application No. 10/868,229, filed on Jun. 15, 2004, now abandoned.

(51) Int. Cl.
*B65D 33/10* (2006.01)

(52) U.S. Cl. ..... 294/152; 294/145; 294/165; 150/154; D23/206

(58) Field of Classification Search ..... 294/27.1, 294/31.2, 137, 145, 149, 150, 152, 165; 150/154, 150/157; 206/0.6; D23/206
See application file for complete search history.

(56) References Cited

U.S. PATENT DOCUMENTS 1,068,066 A 7/1913 Martin
1,395,485 A 11/1921 Duncan
2,464,069 A * 3/1949 Benson ..... 206/466
3,766,954 A 10/1973 Gentellalli
3,964,930 A 6/1976 Reiser
4,556,245 A 12/1985 Gruenwald
5,356,046 A 10/1994 Burke
5,511,846 A 4/1996 Fuller
5,564,568 A * 10/1996 Rankin, Sr. ..... 206/446
5,984,172 A 11/1999 Easterwood
6,006,743 A 12/1999 Shimek et al.
D418,373 S * 1/2000 Fair ..... D7/607
6,012,411 A 1/2000 Hochbrueckner
6,102,230 A 8/2000 Gould
6,123,187 A 9/2000 Bartels
6,142,192 A 11/2000 Dickinson et al.
D457,936 S 5/2002 Garofalo et al.
6,508,282 B2 1/2003 Garofalo et al.
D486,551 S * 2/2004 McQuiston ..... D23/206

* cited by examiner

*Primary Examiner*—Dean J Kramer
(74) *Attorney, Agent, or Firm*—Stetina Brunda Garred & Brucker

(57) ABSTRACT

A portable propane tank carrier system is provided which includes a tank carrier, stabilizer ring, and tank neck cover. The tank carrier includes a rectangular main tank cover panel, and upper and lower radial sidewall panel. The tank carrier closely conforms to the shape of a portable propane tank while providing an upper opening adapted to receive a neck portion of the tank and a lower opening adapted to receive a tank base ring portion of the tank. The stabilizer rings may be attached to the bottom of the tank carrier to prevent the tank from tipping over.

34 Claims, 6 Drawing Sheets

ERGONOMIC PROPANE TANK CARRIER AND STABILIZER

CROSS-REFERENCE TO RELATED APPLICATIONS

The present application is a divisional of U.S. patent application Ser. No. 11/729,160 entitled ERGONOMIC PROPANE TANK CARRIER AND STABILIZER filed Mar. 28, 2007 now U.S. Pat. No. 7,316,435 which is a continuation of U.S. patent application Ser. No. 10/868,229 entitled ERGONOMIC PROPANE TANK CARRIER AND STABILIZER filed Jun. 15, 2004 now abandoned, the entirety of the disclosures of which are expressly incorporated herein by reference.

STATEMENT RE: FEDERALLY SPONSORED RESEARCH/DEVELOPMENT

Not Applicable

BACKGROUND OF THE INVENTION

1. Field of the Invention

The present invention relates to portable propane tank or cylinder carrying devices and covers. In particular, the present invention relates to an ergonomic propane tank carrier device which includes a detachable stabilizer ring.

2. Background of the Invention

Propane tanks (also referred to as cylinders or bottles) are used in various applications, including gas grills or barbecues, RV campers, boats, portable heaters and other activities where devices utilize propane for fuel. For fire protection and consumer safety, the design of portable propane tanks available for use to support the aforementioned activities have become standardized due to enforcement of regulations by the U.S. Department of Transportation (D.O.T.), Transport Canada standards, and the LP Gas Code set forth by National Fire Protection Association and other influential and/or governing agencies.

The typical standardized portable propane tank includes a cylindrical tank which is positioned in a vertically upright manner. Valving hardware is installed in the top of the tank for opening and closing the inlet/outlet of the tank. A cylindrical safety ring or neck is positioned around the valving to protect it from being damaged or even accidentally broken off. Disposed within the neck are large slots which function as handles. Additionally, a cylindrical tank support base ring is used to keep the cylindrical tank in an upright position and supported in a stable manner. Typically, the tank base ring has a smaller diameter than the diameter of the cylindrical tank. Disposed within the tank base ring are slots which are adapted to receive fastening hardware such that the propane tank may be secured to the apparatus of which it supplies fuel to, or to other structure in the near vicinity. The standardized portable propane tanks come in various shapes and sizes including 5 lb., 11 lb., 20 lb., 30 lb. and 40 lb. The most common portable tank size is 20 lbs. In particular, the 20 lb. tank has become the standard size selection for gas fueled barbeque grills.

Although the regulations which influence the design of the portable propane tank have been quite beneficial to the public as a whole, the aforementioned standardized propane tank design still has some disadvantages. One significant disadvantage is that since the tank base ring diameter is smaller than the tank diameter, when the tank is not properly secured, it tends to tip over. Most of the time, the tank is positioned within the apparatus it provides fuel thereto and then fastening hardware is attached through the slots in the tank base ring. However, in many instances the fastening hardware is inadequate. Moreover, when the tank is removed from the apparatus, to be refilled for instance, there is typically no quick and practical way to assure that the portable tank will maintain in an upright position. For instance, it is not uncommon for the portable propane tank to tip over and roll, in particular, while the tank is being transported by to the local LP distributor to be filled up. And unfortunately, inadvertent handling can create considerable safety hazards. Since the portable tank typically is never completely emptied of the liquid propane contained inside or rarely purged with inert gases, the combination of a puncture and spark could result in a deadly explosion.

Another disadvantage of the aforementioned types of portable propane tanks is that the slots formed in the safety neck are somewhat non-ergonomic and tend to dig into the handler's fingers when a full tank is being lifted. Furthermore, the overall height of the 20 lb. tank is roughly about 18 inches, and when filled with liquid propane it weighs roughly about 25 lbs. including the tank weight. The combined effect of the uncomfortable handles positioned low to the ground and the weight of the filled tank, makes moving a filled 20 lb tank very challenging. For instance, when the filled tank is moved, the person must squat down and then lift the tank. In most instances, unless a specialized transportation device is not readily available, moving the tank ends up being a physical struggle to the common user of the tank. Moreover, if not lifted properly, the person lifting the tank may cause physical injury to himself/herself.

It would be beneficial to provide a device in which a standardized portable propane tank could be carried. In particular, it would be advantageous to provide a system which would have ergonomic handles that would not require the common backyard grillmaster or camper to bend over to lift or excessively strain to transport a full tank. Preferably, the device would have a comfortable handle that would not cut into the fingers. Also, if the handle was attached to straps (like a purse), the tank would not have to be lifted quite as high. Such a lifting feature could quite possibly save many people from physical injury incurred from awkward lifting of the filled tank.

Furthermore, as a safety feature it would be advantageous to provide a stabilizing device for the tank carrier such that the tank would not be unstable, particularly while in transport. Preferably, the stabilizing device could be integrated with the carrier device such that both would work together as a system. Ideally, the stabilizer device could be removed such that the securing hardware from the apparatus which uses the tank, may be attached to the tank support base ring. Or if desired, the securing hardware from the apparatus could be removed in lieu of using the stabilizer instead.

Additionally, it would be further beneficial to package the tank carrier and stabilizer in an aesthetically appealing manner. Many consumers have very expensive gas barbeque grills, campers, boats, etc. and an exposed tank is sometimes considered an aesthetic distraction by the owner's of the aforementioned apparatuses.

BRIEF SUMMARY OF THE INVENTION

The present invention is intended to overcome and solve the aforementioned problems commonly associated with using standardized portable propane tanks. According to an exemplary embodiment of the present invention, a portable propane tank carrier system is provided which includes a tank carrier, stabilizer ring, and tank neck cover.

According to one exemplary embodiment, a tank carrier is provided comprising a rectangular main tank cover panel having an upper edge, lower edge, leftside edge and rightside edge; an upper radial sidewall panel having a ring shape with an outer circular edge, inner circular edge and an upper pair of opposing radial edges, the outer circular edge attached to the upper edge of said main tank cover panel; a lower radial sidewall panel having a ring shape with an outer circular edge, inner circular edge, and a lower pair of opposing radial edges, the outer circular edge attached to the lower edge of the main tank cover panel; and a main seam formed by the upper and lower pair of opposing radial edges of the sidewall panels and the leftside and rightside edges of the main tank cover panel; wherein the tank carrier closely conforms to the shape of a portable propane tank while providing an upper opening adapted to receive a neck portion of the tank and a lower opening adapted to receive a tank base ring portion of the tank.

According to an aspect of the present invention, the tank carrier system further includes a handle system to attached to one of the main tank cover panel and the upper radial sidewall panel. The handle system may include a left and right handle strap attached to one of the main tank cover panel and the upper radial sidewall panel. The handle system may further includes a handle attached to one of the left and right handle straps, wherein the handle is adapted to be wrapped around middle portions of the left and right handle straps and fastened to itself.

According to an aspect of the present invention, the tank carrier further includes a plurality of fastening devices positioned along the seam for securing the tank carrier around the tank, wherein the plurality of fastening devices may comprise at least one of buckles, snapping buttons, hook and loop, and a zipper. According to another aspect of the present invention, the tank carrier further includes a pair of circumferential straps attached to the rectangular main tank cover in a parallel and offset orientation to the upper and lower edges of the main tank cover.

Additionally, another aspect of the present invention provides a stabilizer ring adapted to be attached to a bottom portion of the tank carrier. The stabilizer ring has a receiving hole adapted to receive the tank base ring portion. The stabilizer ring may comprise an inner radial panel having a first upper and lower longitudinal edge; an upper radial panel ring having an upper inner ring edge and upper outer ring edge, the upper inner edge attached to the first upper longitudinal edge of the inner radial panel; a lower radial panel ring having a lower inner ring edge and lower outer ring edge, the lower inner ring edge attached to the first lower longitudinal edge of the inner radial panel; and an outer circumferential panel having a second upper and lower longitudinal edge, the second upper longitudinal edge attached to the upper outer ring edge of the upper radial panel, and the second lower longitudinal edge attached to the lower outer ring edge of the lower radial panel. The stabilizer ring may further be filled with a filler material, such as sand. The stabilizer ring may further include a filler seam on the outer circumferential panel for receiving the filler material. In the alternative, the stabilizer ring may include a rigid foam ring maintained within the stabilizer ring. Also, the stabilizer ring may further be attached to the tank carrier via a plurality of fastening devices comprising at least one of buckles, snapping buttons, and hook and loop fasteners.

Moreover, another aspect of the present invention may include a detachable tank neck cover. The detachable tank neck cover may include a circular connecting flange having a outer flange circular edge and an inner flange circular edge, a cylindrical wall formed from a rectangular panel comprising an upper edge and lower edge, the lower edge attached to the inner flange circular edge, and a circular top portion attached to the upper edge of the cylindrical wall. The circular top portion and cylindrical wall may be formed from a mesh material. The tank neck cover may be attached to the tank carrier via a plurality of fastening devices comprising at least one of snapping buttons, and hook and loop fasteners. Additionally, the cylindrical wall portion may have a pair of handle openings adapted to receive tank handles formed on the neck of the tank and a gas supply opening adapted for allowing a gas supply hose to be routed outside said detachable neck cover.

Furthermore, another aspect of the present invention may include an integrally attached tank neck cover. The integrally attached tank neck cover includes a cylindrical wall formed from a rectangular panel comprising an upper edge and lower edge, the lower edge attached to the inner flange circular edge, wherein the lower edge is attached to the inner circular edge of the upper radial sidewall, and a detachable lid adapted to fit atop said cylindrical wall. Preferably, the cylindrical wall is made from a mesh material. Furthermore, the cylindrical wall portion may include a pair of handle openings adapted to receive tank handles formed on the neck of the tank a gas supply opening adapted for allowing a gas supply hose to be routed outside said neck cover.

Furthermore, according to yet another aspect of the present invention, an indicator window is provide on the main tank cover panel. Also, a door flap may be attached to the main tank cover panel for covering the indicator window.

Other exemplary embodiments and advantages of the present invention may be ascertained by reviewing the present disclosure and the accompanying drawings.

BRIEF DESCRIPTION OF THE DRAWINGS

The present invention is further described in the detailed description that follows, by reference to the noted drawings by way of non-limiting examples of preferred embodiments of the present invention, in which like reference numerals represent similar parts throughout several views of the drawings, and in which.

DETAILED DESCRIPTION OF THE INVENTION

Figure 2:
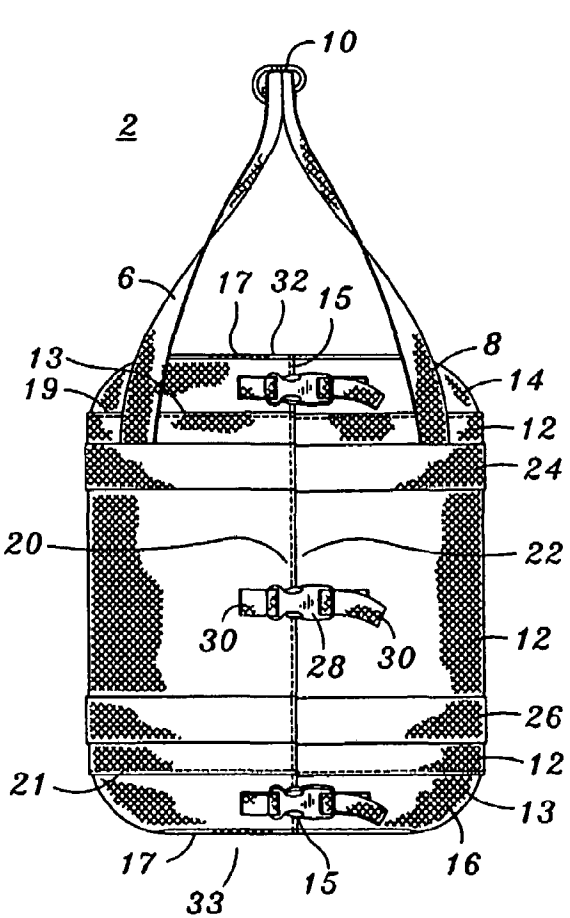
FIG. 2 is a side view of the propane tank carrier and stabilizer which utilizes buckles, according to an aspect of the present invention.
Figure 1:
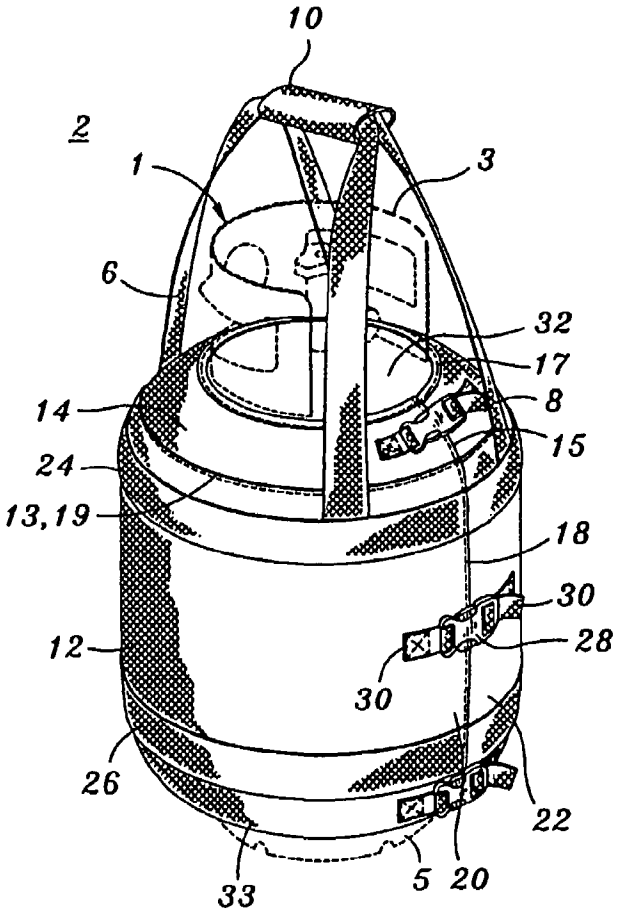
FIG. 1 is a perspective view of an exemplary embodiment of the present invention, that being an ergonomic propane tank carrier and stabilizer system, according to an aspect of the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIGS. 1 through 13 illustrate several exemplary embodiments of the present invention, that being an ergonomic portable propane tank carrier 2 and stabilizer ring 4, according to an aspect of the present invention. The present invention further simultaneously functions as a tank cover. The stabilizer ring 4 may be removably attached to the bottom of the carrier device 2 to provide extra support for maintaining a propane tank 1 in an upright position. Moreover, the present invention may include tank neck cover 60 which may be removably attached to an upper portion of the carrier device 2. The ergonomic tank carrier 2 and stabilizer ring 4 may be made from a variety of materials which may be cut to size and sewn, bonded or glued together. It is noted that the scope of the present invention should not be limited to the choice of material used to manufacture the ergonomic tank carrier 2 and stabilizer ring 4.

An Exemplary Ergonomic Portable Propane Tank Carrier

The ergonomic tank carrier 2 is formed from three panels including a main tank cover 12 which wraps around the cylindrical portion of the tank 1, an upper radial sidewall 14 which covers the top portion of the tank 1 except for the safety ring or neck 3 of the tank 1, and a lower radial sidewall 16 which covers a bottom portion of the tank 1 except for the tank base ring 5. The panel of the main tank cover 12 is preferably cut in a rectangular shape such that it may be wrapped around the exterior perimeter wall of the tank 1. The rectangular shaped panel includes a leftside edge 20, rightside edge 22, upper edge 19 and lower edge 21. Both the upper and lower radial sidewall 14, 16 panels are cut into a circular shape which forms a ring (e.g., similar to the sidewalls of a tire) having an outer circular edge 13 and inner circular edge 17. A cut is made in the ring in a radial direction forming a pair of radial oriented edges 15. The outer circular edge 13 of the upper radial sidewall 14 is attached to the upper edge 19 of the main tank cover 12 and the outer circular edge 13 of the lower radial sidewall 16 is attached to the lower edge 21 of the main tank cover 12 to form the tank carrier 2 which has a similar shape to the propane tank 1.

The tank carrier 2 has an attachable/detachable seam 18 which is formed by the leftside and rightside edges 20, 22 of the main tank cover 12 and the radial oriented edges 15 of both the upper and lower radial sidewall 14, 16. To secure the seam 18 together, a variety of fastening devices may be utilized including, but not limited to buckles 30, snapping buttons 34, a zipper 36, hook and loop fasteners 58 or the like. FIGS. 1, 2, 6 and 7 show an exemplary utilization of buckles 28 to secure the seam 18 together. In particular, a plurality of buckles 28 are attached to connecting straps 30 which are positioned transversely to the seam 18. The buckles 28 are then attached to the connecting straps 30 such that both sides 20, 22 of the tank carrier 2 can be drawn together and secured around the propane tank 1.

Figure 5:
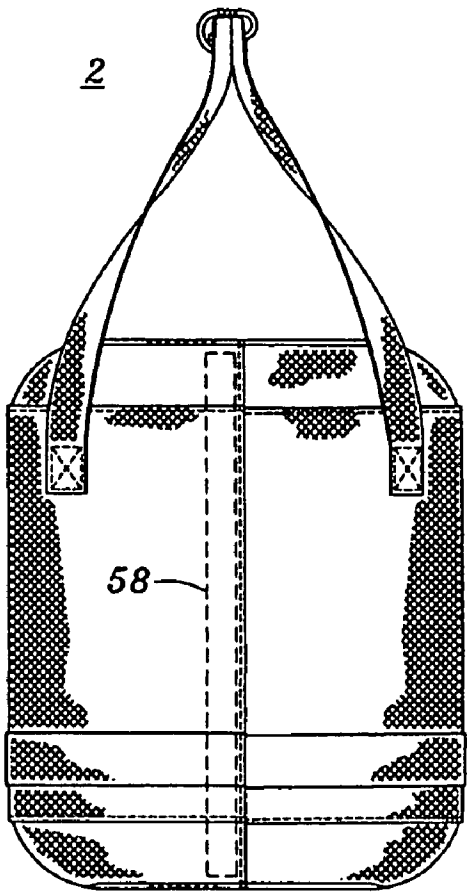
FIG. 5 is a side view of another alternative embodiment of the propane tank carrier and stabilizer which uses hook and loop fasteners, according to an aspect of the present invention.
Figure 4:
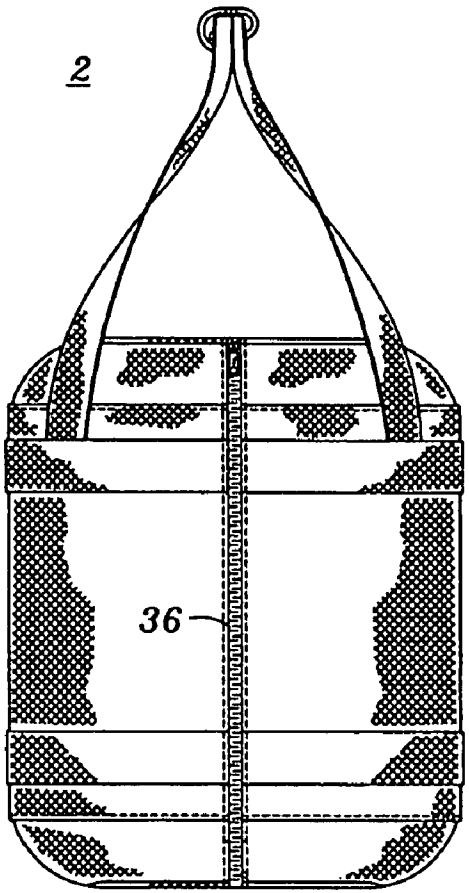
FIG. 4 is a side view of another alternative embodiment of the propane tank carrier and stabilizer which uses a zipper, according to an aspect of the present invention.
Figure 3:
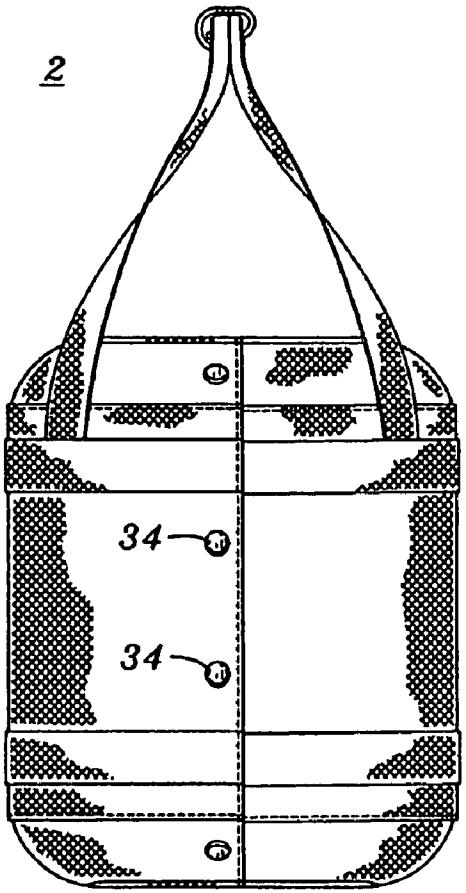
FIG. 3 is a side view of an alternative embodiment of the propane tank carrier and stabilizer which uses snapping buttons, according to an aspect of the present invention.

Alternative manners to secure the seam 18 together are also shown in FIGS. 3 through 5. FIG. 3 is a side view of an alternative embodiment of the propane tank carrier 2 which uses snapping buttons 34, according to an aspect of the present invention. FIG. 4 is a side view of another alternative embodiment of the propane tank carrier 2 which uses a zipper 36, according to an aspect of the present invention. And, FIG. 5 is a side view of another alternative embodiment of the propane tank carrier 2 which uses hook and loop fasteners 58, according to an aspect of the present invention.

Figure 7:
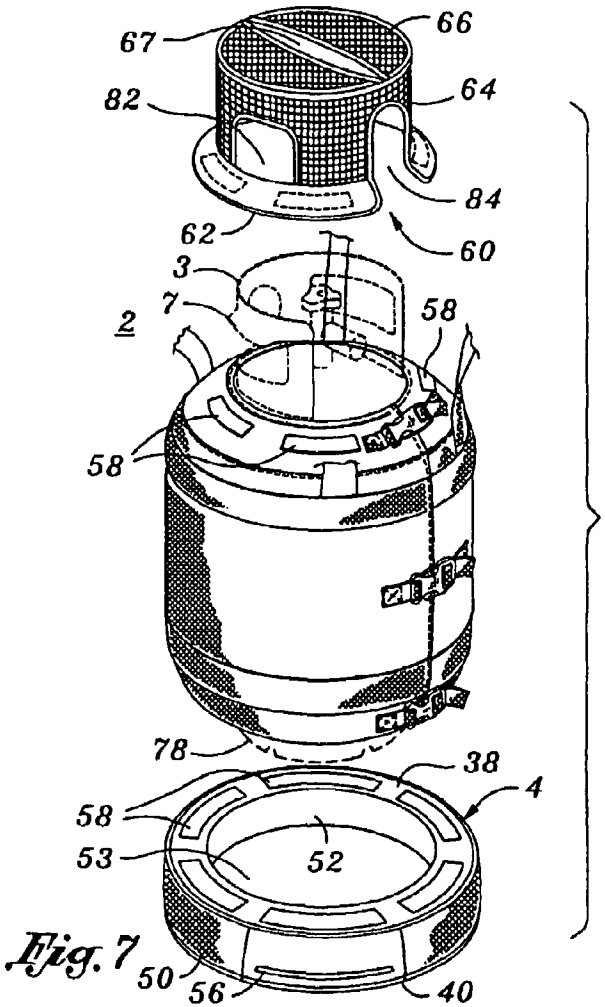
FIG. 7 is an exploded perspective view of the propane tank carrier and stabilizer from FIG. 6 which shows the stabilizer ring detached to the bottom of the carrier and the tank neck cover removed from the neck of the tank, according to an aspect of the present invention.
Figure 6:
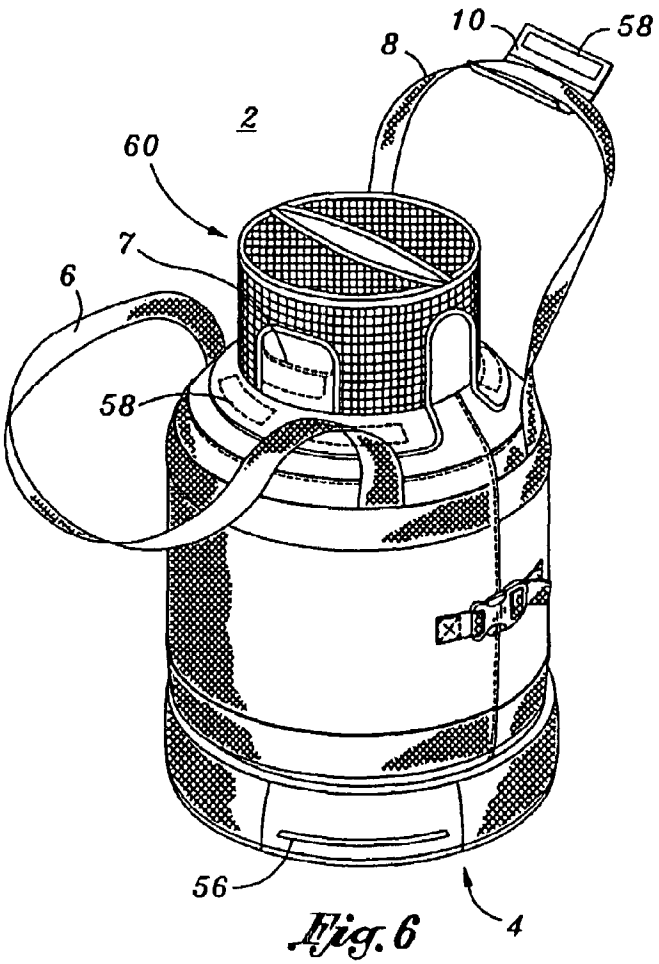
FIG. 6 is a perspective view of the propane tank carrier and stabilizer which has a stabilizer ring attached to the bottom of the carrier by hook and loop and a tank neck cover attached around the neck of the tank, according to an aspect of the present invention.
Figure 9:
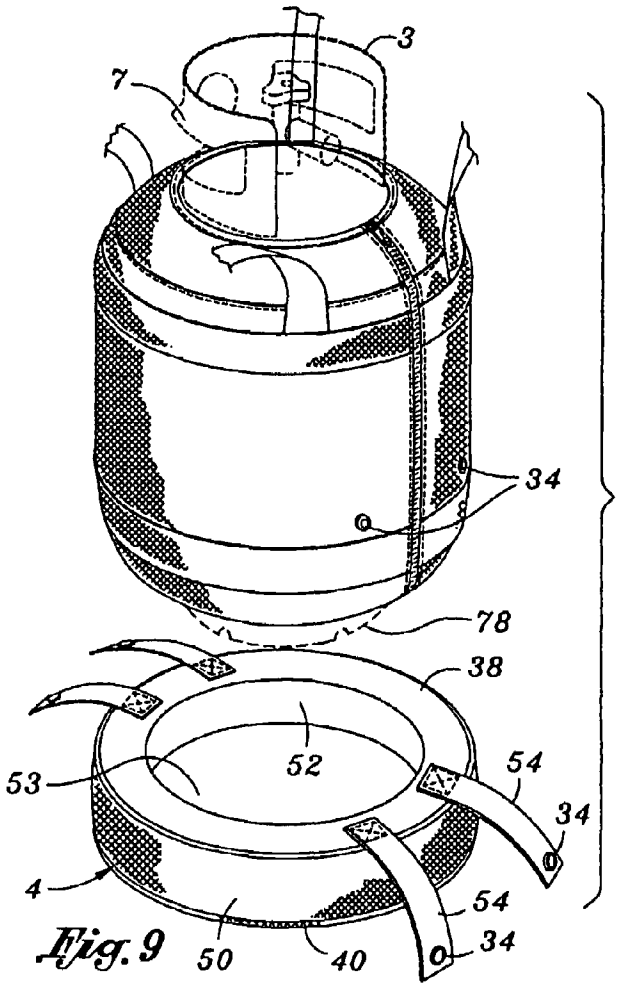
FIG. 9 is an exploded perspective view of the propane tank carrier and stabilizer from FIG. 9 which shows the stabilizer ring with attachment straps and snapping buttons detached from the bottom of the carrier, according to an aspect of the present invention.
Figure 8:
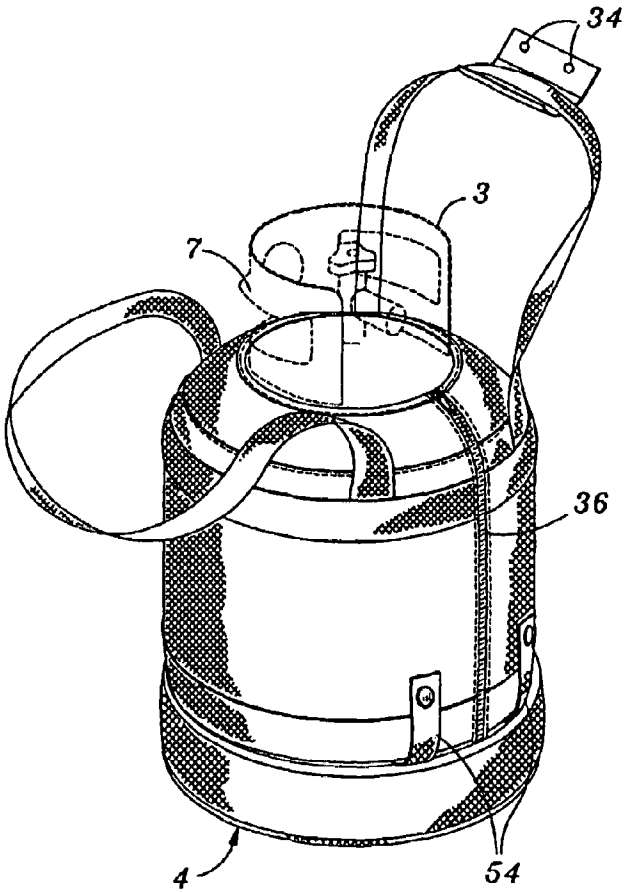
FIG. 8 is a perspective view of the propane tank carrier and stabilizer which has a stabilizer ring attached to the bottom of the carrier by attachment straps and snapping buttons, according to an aspect of the present invention.
Figure 11:
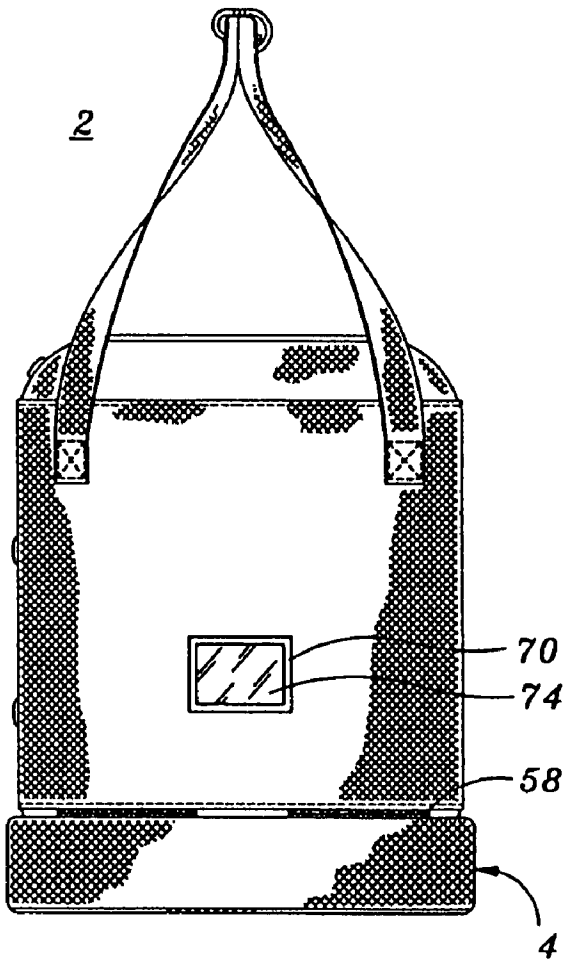
FIG. 11 is a side view of the propane tank carrier and stabilizer which includes a level indicator window and further shows the stabilizer ring attached to the bottom of the carrier via hook and loop fasteners, according to an aspect of the present invention.

The tank carrier 2 may further include an upper circumferential strap 24 and a lower circumferential strap 26 which extend the length of the main tank cover 12 as shown in FIGS. 1 through 4 and FIGS. 6 through 10. In other embodiments of the tank carrier 2, straps 24, 26 are not utilized as shown in FIGS. 5 and 11. The tank carrier 2 further includes a handle system which includes a left handle strap 6, right handle strap 8, and a handle portion 10. In more particularity, distal ends of the handle straps 6, 8 are attached to the tank carrier 2, preferably in the vicinity between the upper circumferential strap 24 and the upper edge 19 of the main tank cover 12. As shown in FIGS. 6 and 8, the handle portion 10 is a flat rectangular of material which is attached to the middle of one of the handle straps 6, 8. Once the tank 1 is installed into the tank carrier 2, the handle portion 10 is wrapped around the middle portions of the straps 6, 8 and secured together, preferably by hook and loop fastener 58 or snapping buttons 34 to form the handle system.

Figure 10:
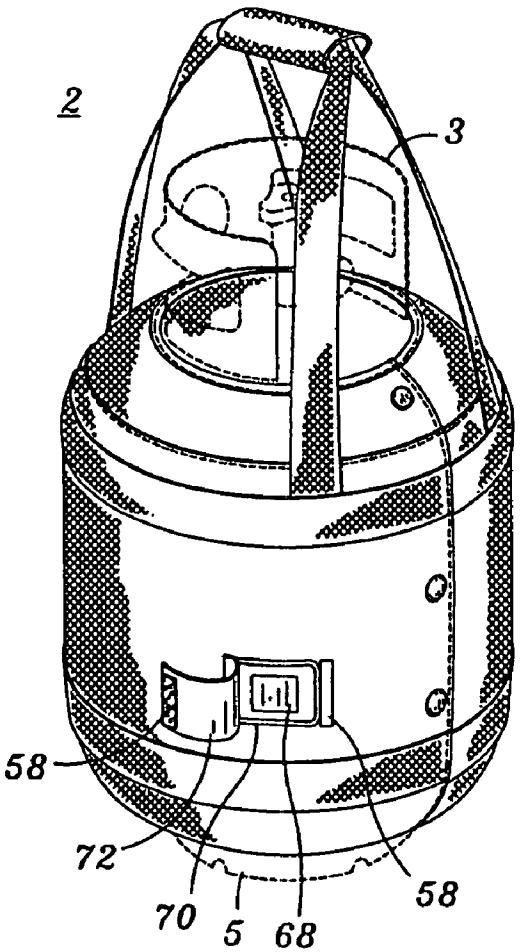
FIG. 10 is a perspective view of the propane tank carrier and stabilizer which also includes a level indicator window and door flap, according to an aspect of the present invention.

It is also noted that many portable propane tanks 1 have a level indicator means adhesively applied to the cylindrical side of the tank 1. So that the consumer may be able to read the level indicator (if one is indeed applied to the tank 1), an indicator window 70 may be optionally be provided on the tank carrier 2 as shown in FIGS. 10 and 11. The window 70 may have a hole of any shape or size which allows the level indicator to be clearly viewed. The embodiment shown in FIG. 10, includes a door flap 72 which may be used to cover the window 70 when not in use. One side of the door flap 72 may be sewn or permanently attached to the main tank cover 12 while the opposing side may be secured to the main tank 12 cover via hook and loop 58 or snapping buttons 34. Another embodiment of the window 70 is shown in FIG. 11 which does not use a door flap 72. Instead, clear sheet of plastic 74 may be attached to the main tank cover 12 to form a window 70 similar to a picture display feature in a wallet.

An Exemplary Stabilizer Ring

The exemplary stabilizer ring 4 is provided as a feature which prevents the tank 1 from tipping over. The ring 4 has a tank base ring receiving hole 53 with a diameter which sized to receive the tank base ring 5. The outer diameter of the stabilizer ring 4 is preferably generally about equal to the outer diameter of the propane tank 1. The inner diameter of the receiving hole 53 has a diameter slightly greater than the diameter of the base ring 5. An exemplary stabilizer ring 4 includes an upper radial panel 38, lower radial panel 40, inner circumferential panel 52, and an outer circumferential panel 50. The inner circumferential panel 52 may be formed from an elongated rectangular strip having a length which allows formation of the receiving hole 53 having a diameter slightly greater than the diameter of the tank base ring 5. The outer circumferential panel 50 is also formed from an elongated rectangular strip having a length which allows the resulting diameter of the ring 4 to be about equivalent to the diameter of the tank 1.

The stabilizer ring 4 may be filled with a variety of materials. For instance, in the embodiment shown in FIG. 7, the ring 4 is filled with a filler material, such as sand (or any material which may be used to fill bean bags) such that the ring 4 may conform to the surface of which it rests on and to the bottom of the tank 1. With this embodiment, a filler seam 58 (see FIGS. 6 and 7) may be provided on the outer panel 50 so that the filler material can be filled into the ring 4. Or in another embodiment shown in FIG. 9, a precut rigid foam ring may be utilized to form the body of the ring. In this case, upper radial panel 38, lower radial panel 40, inner circumferential panel 52, and an outer circumferential panel 50 are assembled around the foam ring.

The stabilizer ring 4 may be attached to the bottom of the tank carrier 2 in a variety a manners, including hook and loop 58 and/or snapping buttons 34. For example, as shown in FIGS. 7 and 11, hook and loop fasteners 58 may be affixed to the upper radial panel 38 and to the lower radial sidewall 16 of the tank carrier 2 (not shown). In the alternative, a plurality of attachment straps 54 with snapping buttons 34 may be attached to the outer circumferential panel 50 of the ring 4 transverse to the longitudinal length of the outer panel 50. Or in the alternative, the attachment straps 54 may utilize hook and loop fasteners 58 to attach the straps 54 to the tank carrier 2.

Exemplary Tank Neck Covers

A first exemplary detachable tank neck cover 60 is shown in FIGS. 6 and 7. The neck cover 60 includes a connecting flange 62, a cylindrical wall 64, circular top portion 66, handle openings 82, gas supply opening 84, and a valve access slot 67. The connecting flange 62 is preferably made from the same material as the tank carrier 2 and the stabilizer ring 4. While the cylindrical wall 64 and the circular top portion 66 are preferably made from a mesh or net material. The shape of the panel used to form the connecting flange 62 is a ring which has a hole which is adapted to fit over the neck 3 of the tank 1. The panel used to form the cylindrical wall 64 may be a rectangular shape having a length slightly larger than the circumference of the neck 3 and height slightly larger than the neck 3. The panel used to form the circular top portion 66 is preferably a circular shape. Formed within the cylindrical wall 64 are a pair of handle openings 82 which are adapted to receive the tank handles 7 such that the handles 7 may protrude outward from the tank neck cover 60. Additionally, the gas supply opening 84 is formed within the cylindrical wall 64 and through a radially section of the connecting flange 62. The gas supply opening 84 allows the gas supply hose (not shown) to be run from the tank 1 valving to the apparatus of which gas is supplied thereto. Moreover, the valve access slot 67 is disposed across the circular top portion 66 of the neck cover 60 so that one can insert their hand through the cover 60 to open or close the tank gas inlet/outlet valve. The detachable neck cover 60 is preferably attached to the upper radial sidewall 14 of the tank carrier 2 using hook and loop 58 (see FIG. 7) or snapping buttons 34.

Figure 13:
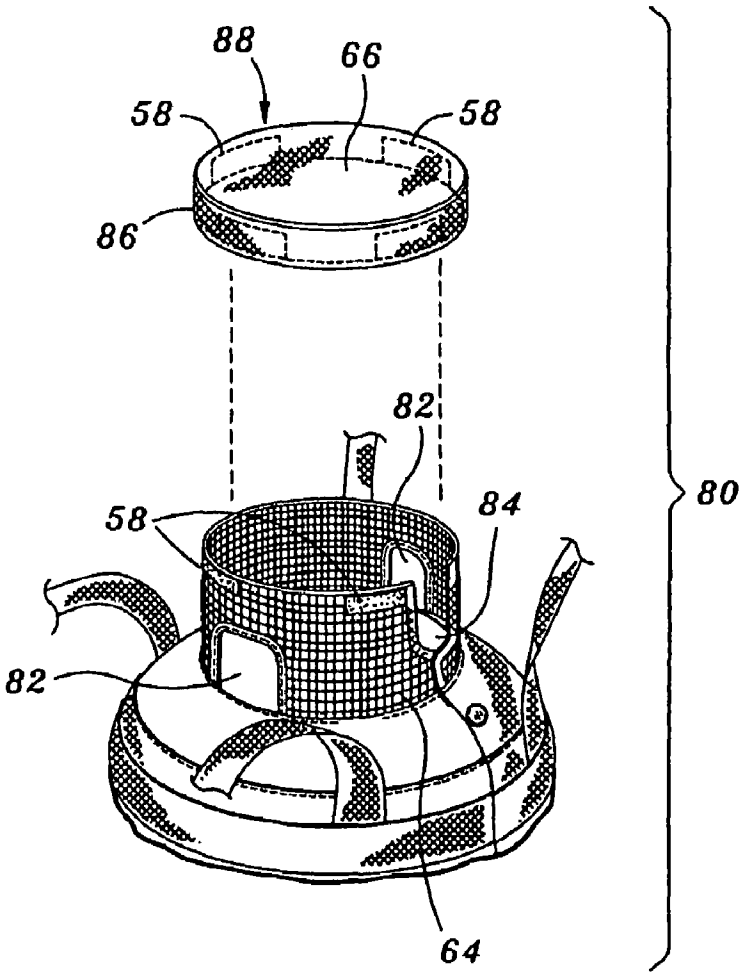
FIG. 13 is an exploded view of the integrally attached cover and the detachable lid, according to an aspect of the present invention.
Figure 12:
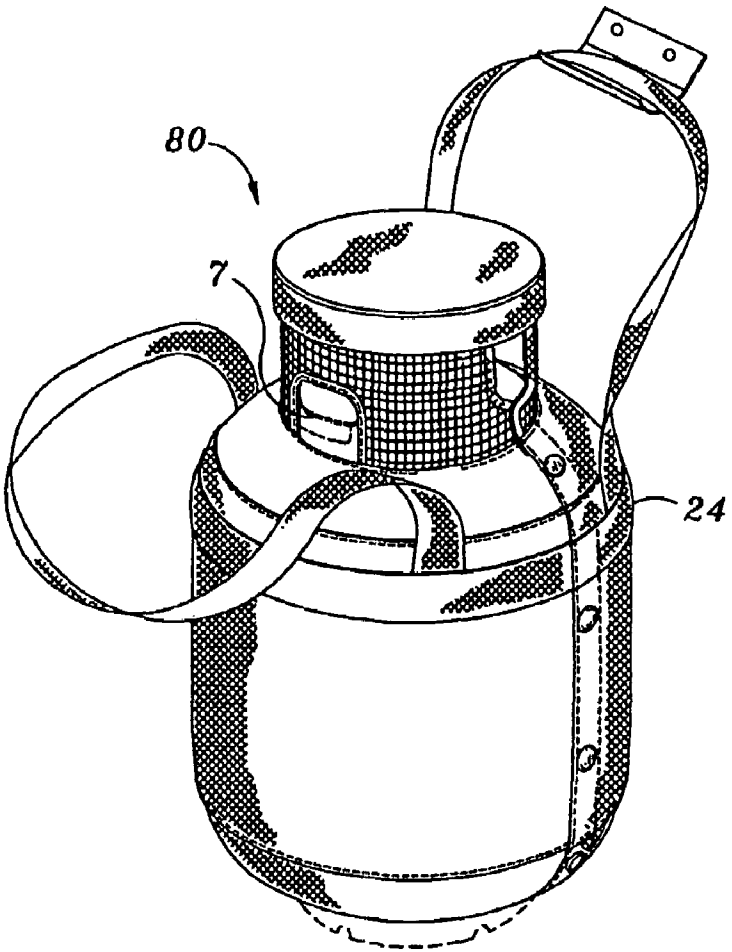
FIG. 12 is a perspective view of the propane tank carrier which has a stabilizer ring an integrally attached tank neck cover with detachable lid, according to an aspect of the present invention.

Another exemplary integrally attached tank neck cover 80 is shown in FIGS. 12 and 13. The neck cover 80 includes a cylindrical wall 64 having handle openings 82 and a gas supply opening 84. The cover also includes a detachable lid 88 formed from circular top portion 66 and a securing rim 86. The cylindrical wall 64 and the detachable lid 88 are preferably made from a mesh or net material. The panel used to form the cylindrical wall 64 may be a rectangular shape having a length slightly larger than the circumference of the neck 3 and height slightly larger than the neck 3. In this embodiment, the cylindrical wall 64 is attached to the inner circular edge 17 of the tank carrier and a radial cut is made transverse to the panel such that the main seam 18 may be extended through the cylindrical wall 64. Formed within the cylindrical wall 64 are a pair of handle openings 82 which are adapted to receive the tank handles 7 such that the handles 7 may protrude outward from the tank neck cover 60. Additionally, the gas supply opening 84 is formed within the cylindrical wall 64 by removing a radial section of the cylindrical wall near the radial cut which forms part of the main seam 18. The gas supply opening allows the gas supply hose (not shown) to be run from the tank 1 valving to the apparatus of which gas is supplied thereto. The detachable lid 88 is made from a circular top portion 66 is preferably a circular shape and the securing rim 86 may be formed from a panel having a shape of an elongated strip. Preferably hook and loop fastener 58 is used to attach the lid 88 to the upper rim portion of the cylindrical wall 64 of the integrally attached tank neck cover 80. Additionally, a portion of the securing rim 86 can also be attached, preferably sewn, to form a hinge between the lid 88 and the cylindrical wall 64.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed; rather, the invention extends to all functionally equivalent structures, methods, and such uses are within the scope of the appended claims.

What is claimed is:

1. A portable propane tank carrier system comprising:

a tank carrier comprising, a rectangular main tank cover panel having an upper edge, lower edge, leftside edge and rightside edge;

an upper radial sidewall panel having a ring shape with an outer circular edge, inner circular edge and an upper pair of opposing radial edges, said outer circular edge attached to said upper edge of said main tank cover panel;

a lower radial sidewall panel having a ring shape with an outer circular edge, inner circular edge, and a lower pair of opposing radial edges, said outer circular edge attached to said lower edge of said main tank cover panel; and a main seam formed by said upper and lower pair of opposing radial edges of said sidewall panels and said leftside and rightside edges of said main tank cover panel;

wherein said tank carrier closely conforms to the shape of a portable propane tank while providing an upper opening adapted to receive a neck portion of the tank and a lower opening adapted to receive a tank base ring portion of the tank; and a stabilizer ring adapted to be attached to a bottom portion of said tank carrier.

2. The tank carrier system according to claim 1, said stabilizer ring having a receiving hole adapted to receive the tank base ring portion.

3. The tank carrier system according to claim 1, said stabilizer ring comprising, an inner radial panel having a first upper and lower longitudinal edge;

an upper radial panel ring having an upper inner ring edge and upper outer ring edge, said upper inner edge attached to said first upper longitudinal edge of said inner radial panel;

a lower radial panel ring having a lower inner ring edge and lower outer ring edge, said lower inner ring edge attached to said first lower longitudinal edge of said inner radial panel; and an outer circumferential panel having a second upper and lower longitudinal edge, said second upper longitudinal edge attached to said upper outer ring edge of said upper radial panel, and said second lower longitudinal edge attached to said lower outer ring edge of said lower radial panel.

4. The tank carrier system according to claim 3, said stabilizer ring filled with a filler material.

5. The tank carrier system according to claim 4, wherein said filler material is sand.

6. The tank carrier according to claim 4, said stabilizer ring further including a filler seam on said outer circumferential panel for receiving said filler material.

7. The tank carrier system according to claim 3, said stabilizer ring further including a rigid foam ring maintained within said stabilizer ring.

8. The tank carrier system according to claim 3, said stabilizer ring further attached to said tank carrier via a plurality of fastening devices comprising at least one of buckles, snapping buttons, and hook and loop fasteners.

9. The tank carrier system of claim 3 wherein the stabilizer ring further includes a plurality of attachment straps, each attachment strap being connectable to the tank carrier.

10. The tank carrier system of claim 1 wherein the stabilizer ring further includes a plurality of attachment straps, each attachment strap being connectable to the tank carrier.

11. The tank carrier system of claim 10 further comprising a plurality of first and second snap fasteners, each first snap fastener being engageable with a respective second snap fastener, each first snap fastener being connected to a respective one of the plurality of attachment straps, each second snap fastener being connected to the tank carrier.

12. The tank carrier system of claim 10 wherein the plurality of attachment straps are circumferentially disposed about the stabilizer ring.

13. The tank carrier system of claim 12 wherein the plurality of attachment straps are evenly disposed about the stabilizer ring.

14. The tank carrier system according to claim 1, said stabilizer ring filled with a filler material.

15. The tank carrier system according to claim 14, wherein said filler material is sand.

16. The tank carrier according to claim 14, said stabilizer ring further including a filler seam on said outer circumferential panel for receiving said filler material.

17. The tank carrier system according to claim 1, said stabilizer ring further including a rigid foam ring maintained within said stabilizer ring.

18. The tank carrier system according to claim 1, said stabilizer ring further attached to said tank carrier via a plurality of fastening devices comprising at least one of buckles, snapping buttons, and hook and loop fasteners.

19. The tank carrier system according to claim 1, further comprising a plurality of fastening devices positioned along said seam for securing said tank carrier around the tank.

20. The tank carrier system according to claim 19, said plurality of fastening devices comprising at least one of buckles, snapping buttons, hook and loop, and a zipper.

21. The tank carrier system according to claim 1, further comprising a detachable tank neck cover.

22. The tank carrier system according to claim 21, said detachable tank neck cover comprising, a circular connecting flange having a outer flange circular edge and an inner flange circular edge;

a cylindrical wall formed from a rectangular panel comprising an upper edge and lower edge, said lower edge attached to said inner flange circular edge; and a circular top portion attached to said upper edge of said cylindrical wall.

23. The tank carrier system according to claim 22, circular top portion comprising a mesh material.

24. The tank carrier system according to claim 23, said cylindrical wall comprising a mesh material.

25. The tank carrier system according to claim 22, said tank neck cover further attached to said tank carrier via a plurality of fastening devices comprising at least one of snapping buttons, and hook and loop fasteners.

26. The tank carrier system according to claim 22, said cylindrical wall portion having a pair of handle openings adapted to receive tank handles formed on the neck of the tank.

27. The tank carrier system according to claim 26, further comprising a door flap attached to said main tank cover panel for covering said indicator window.

28. The tank carrier system according to claim 22, said cylindrical wall portion having a gas supply opening adapted for allowing a gas supply hose to be routed outside said detachable neck cover.

29. The tank carrier system according to claim 22, said cylindrical wall portion having a gas supply opening adapted for allowing a gas supply hose to be routed outside said neck cover.

30. The tank carrier system according to claim 21, said integrally attached tank neck cover comprising, a cylindrical wall formed from a rectangular panel comprising an upper edge and lower edge, said lower edge attached to said inner flange circular edge, wherein said lower edge is attached to said inner circular edge of said upper radial sidewall; and a detachable lid adapted to fit atop said cylindrical wall.

31. The tank carrier system according to claim 30, said cylindrical wall comprising a mesh material.

32. The tank carrier system according to claim 31, said cylindrical wall portion having a pair of handle openings adapted to receive tank handles formed on the neck of the tank.

33. The tank carrier system according to claim 1, further comprising an integrally attached tank neck cover.

34. The tank carrier system according to claim 1, further comprising an indicator window on said main tank cover panel.

* * * * *